United States Patent [19]

Namiki et al.

[11] 4,013,871

[45] Mar. 22, 1977

[54] IMAGE FIXING ROLL FOR ELECTROPHOTOGRAPHY

[75] Inventors: Ryoichi Namiki, Hino; Shigeru Muramatsu, Tokyo, both of Japan

[73] Assignee: Ricoh Co., Ltd., Tokyo, Japan

[22] Filed: Apr. 15, 1975

[21] Appl. No.: 568,310

Related U.S. Application Data

[63] Continuation of Ser. No. 328,963, Feb. 2, 1973, abandoned.

[30] Foreign Application Priority Data

Feb. 9, 1972 Japan ..... 47-14175
Mar. 1, 1972 Japan ..... 47-21209

[52] U.S. Cl. ..... 219/471; 219/216; 219/469

[51] Int. Cl.[2] ..... H05B 1/02

[58] Field of Search ..... 165/32, 81, 89; 117/21; 219/216, 469, 470, 471; 317/262 A; 335/3, 14

[56] References Cited

UNITED STATES PATENTS

| | | | |
|---|---|---|---|
| 3,629,549 | 12/1971 | Svendsen | 219/216 X |
| 3,669,706 | 6/1972 | Sanders et al. | 219/216 X |
| 3,725,639 | 4/1973 | Sell et al. | 219/469 X |

*Primary Examiner*—J D Miller
*Assistant Examiner*—Fred E. Bell
*Attorney, Agent, or Firm*—Cooper, Dunham, Clark, Griffin & Moran

[57] ABSTRACT

A roll for fixing a toner image formed on a support sheet in electrophotography comprising a plurality of layers made of a resilient material and arranged around a core disposed about the center axis of the roll. The resilient material layer disposed nearer to the core is electrically conductive and serves to make the roll function as a heating roll. It has a higher hardness than the resilient material layers remote from the core.

22 Claims, 6 Drawing Figures

IMAGE FIXING ROLL FOR ELECTROPHOTOGRAPHY

This is a continuation of application Ser. No. 328,963 filed Feb. 2, 1973, now abandoned.

BACKGROUND OF THE INVENTION

This invention relates to fixing rolls for electrophotography, and more particularly it is concerned with a roll for heating and fixing a toner image on a support sheet in electrophotography.

The quickest and most positive method for fixing a toner image formed on a support sheet as by transfer printing consists in directly heating the toner image with a heating roll to cause the same to adhere by fusion or melt adhesion to the copy sheet. It has hitherto been in practice to bring the toner image into direct contact wih a heated surface, such as the periphery of a heating roll, to fix the toner image.

This method has, however, a disadvantage in that what is referred to as an offset phenomenon tends to occur during the process. More specifically, when a toner image is heated and the toner particles become tacky, some portions of the toner image supported by a support sheet may adhere to the surface of the heating roll and may be transferred to the next following sheet. Then, some portions of the toner image on the second sheet may adhere to the heating roll and may be transferred to the third sheet. This cycle may be repeated till a desired number of copies have been produced. The transfer of portions of the toner image on the preceding support sheet to the next following support sheet is the aforementioned offset phenomenon.

The offset phenomenon is not desirable and should be precluded in fixing toner images on support sheets. In order to preclude the offset phenomenon, it is required that the peripheral surface of the heating roll should be finished such that the surface is as smooth as glass. However, conventional heating rolls are constructed such that it is impossible to impart glass-like smoothness to their peripheral surfaces by grinding.

More specifically, when non-tacky rolls are made, their peripheral surfaces are ground. Thus, the surfaces are matted, and it is impossible to render the surfaces of rolls as smooth as glass. Toner images tend to adhere to such surfaces even if they are non-tacky.

On the other hand, toner image fixing rolls are preferably resilient and heat conductive. The reason why such rollers are preferably resilient will be explained in some detail immediately below in connection with FIGS. 1 and 2.

FIG. 1, which is slightly exaggerated to enable essential points to be readily understood, shows a heating and fixing device comprising a heating and fixing roll 2 adapted to be brought directly into engagement with a toner image P formed on a support sheet 1, and a pressing roll 3 disposed over heating and fixing roll 2 and adapted to bear against the same. Heating and fixing roll 2 and pressing roll 3 are driven by drive means (not shown) to rotate in the directions of arrows *a* and *b* respectively.

The support sheet 1 carrying the toner image P thereon is fed between the two rollers 2 and 3 so as to heat and fix the image P on support sheet 1. If heating and fixing roll 2 had no resilience, support sheet 1 would tend to get stuck on the peripheral surface of heating and fixing roll 2 and move with roll 2 in the direction of an arrow C even if means is provided for precluding the offset phenomenon, because pressing roll 3 has resilience and increases the amount of contact between the two rollers. Thus, copy sheet jam would ensue. In order to preclude copy sheet jam, it is desirable that heating and fixing roll 2 should have resilience.

If heating and fixing roll 2 had resilience, a portion of the peripheral surface of heating and fixing roll 2 which is brought into engagement with the peripheral surface of pressing roll 3 would be slightly concave as shown in FIG. 2, and copy sheet 1 would be discharged in the direction of an arrow *d* after its image has been fixed. Thus, copy sheets can be fed smoothly without being jammed.

The heating and fixing roll is preferably heat conductive for the following reason: It is only the peripheral surface of a heating and fixing roll that is required to be heated. Generally, heating rolls are constructed such that a heater serving as a heat source is built in the interior of each roll and surrounded by a layer of an insulating material, such for example as silicone rubber having a specific resistance of over $10^{15}\Omega$cm. Thus, conventional heating and fixing rolls have poor heat conductivity and the heat generating source must have a high wattage. In addition, the layer surrounding the heater must meet the requirement that it should be heat resistant.

Since conventional heating rolls each have a heater in the central portion, a portion of the rolls near the center axis tends to have an elevated temperature. Thus, when the heating rolls are made of rubber or other materials of low rigidity, they are softened by heat and become unfit to be used as heating rolls. This makes it necessary to use rubber of high rigidity to impart high mechanical strength to the heating rolls. However, it is not desirable to increase surface hardness of heating rolls in order to preclude the offset phenomenon.

SUMMARY OF THE INVENTION

This invention has as its object the provision of a heating and fixing roll which comprises a plurality of resilient material layers arranged around a core disposed about the center axis of the roll, and which is resilient, heat conductive and heat resistant.

The provision of a plurality of resilient material layers permits to obtain a toner image fixing roll for electrophotography which is highly resilient, highly heat conductive and highly heat resistant because each layer can be produced by a material freely selected to suit the purpose.

DESCRIPTION OF PREFERRED EMBODIMENTS OF THE INVENTION

Figure 1:
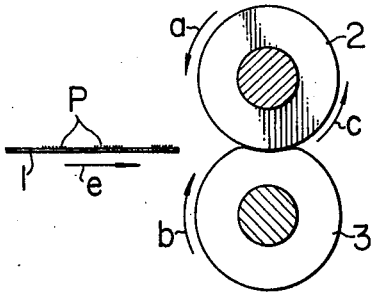
FIG. 1 and FIG. 2 are sectional views of a heating and fixing device in explanation of the reason why a fixing roll has to have resilience.
Figure 2:
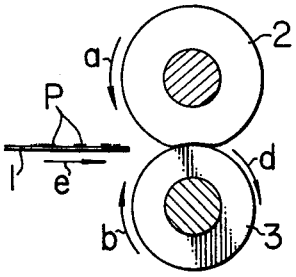
Figure 3:
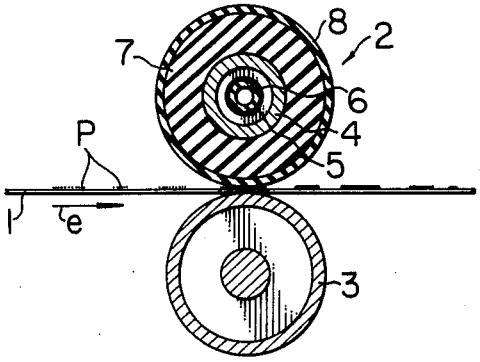
FIG. 3 is a sectional view of a heating and fixing device using the fixing roll comprising one embodiment of the invention.

In the heating and fixing device shown in FIG. 3, a support-sheet 1 formed on its surface with a toner image P is adapted to move in the direction of an arrow *e*. Disposed over sheet 1 is a fixing roll 2 whose peripheral surface is brought into direct contact with the toner image P on sheet 1. Fixing roll 2 comprises a tubular shaft 4 arranged about the center axis of the roll for housing therein a heat source 5 which may be a coil heater. Heat source 5 is wound on a glass rod 6 disposed in the center axis of the roll and serves to make the roll function as a heating roll. Glass rod 6 and tubular shaft 4 constitute the core of roll 2. A first layer 7 made of conductive rubber having a volume resistivity of below $10^8\Omega$cm is mounted on the outer surface of tubular shaft 4. First layer 7 of roll 2 may be made of conductive rubber comprising 30 to 50% by weight of carbon powder. Besides carbon, an inorganic material, silica or the like may be used as a filler. Iron, titanium, cadmium, cobalt, red oxice or other pigment may be added to the material making up first layer 7.

The conductive rubber making up first layer 7 is highly resistant to heat and yet highly heat conductive and has a high service life because of the presence of carbon therein.

A second layer 8 made as of a silicone resin is provided on the outer peripheral surface of first layer 7 which second layer is adapted to preclude the offset phenomenon. Second layer 8 may be formed on first layer 7 by applying the resin thereto to form a coat. Thus, the peripheral surface of layer 8 which is nontacky can be made as smooth as glass, thereby permitting to preclude the offset phenomenon.

Disposed beneath the fixing roll 2 constructed as aforementioned is a pressing roll 3 whose peripheral surface is adapted to be brought into engagement with the underside of support sheet 1. Roll 3 is made, at least at its perpheral surface, with silicone rubber or other material which is heat resistant and resilient. The two rolls 2 and 3 are disposed such that they press against each other to form therebetween a path of movement for image support sheet 1.

The fixing roll according to the invention is constructed as aforementioned. Thus, when image support sheet 1 moves along the path between fixing roll 2 and pressing roll 3, the toner image P formed on sheet 1 is brought into contact with the peripheral surface of fixing roll 2 which is heated by heat source 5, so that toner image P is fused and fixed on the support sheet. Fixing of the image is promoted by the pressure applied to fixing roll 2 by pressing roll 3. Since the surface of second layer 8 forming the peripheral surface of roller 2 is as smooth as glass, adhesion of some of the toner particles forming the image P to the fixing roll can be prevented.

Results of experiments show that the fixing roll constructed according to the invention is over ten times as high in mechanical strength as, and 30 to 50% more heat resistant than, conventional fixing rolls.

Figure 4:
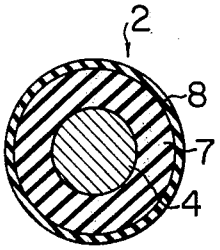
FIG. 4 is a sectional view of the fixing roll comprising a second embodiment of the invention.

The fixing roll 2 of the embodiment described above has built-in heating source 5 therein so as to generate heat for fixing the toner image by fusion or melt adhesion. The fixing roller 2 may have no built-in heating source therein as shown in FIG. 4 and it may be heated from outside by some suitable means.

A current may be passed to the first layer 7 of fixing roll 2 which is made of conductive rubber, so that layer 7 may generate heat for fixing the toner image by melt adhesion.

Figure 5:
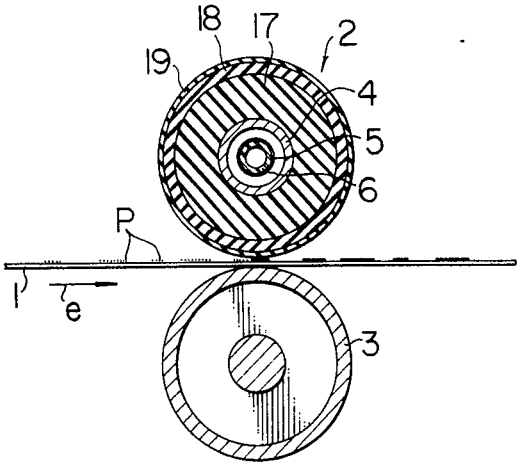
FIG. 5 is a sectional view of the fixing roll comprising a third embodiment of the invention.

In the embodiment shown in FIG. 5, a first layer 17 of high hardness arranged on the outer peripheral surface of tubular shaft 4 is made of heat resistant rubber and has a thickness of 5 millimeters and a hardness of 70. A second layer 18 of medium hardness arranged on the outer peripheral surface of first layer 17 is made of heat resistant rubber and has a thickness of 1 millimeter and a hardness of 60. A third layer 19 of low hardness arranged on the outer peripheral surface of second layer 18 is made of heat resistant rubber and has a thickness of 100 microns and a hardness of 40. The hardness of each layer represents the value for each layer calculated as having the same thickness.

When support sheet 1 formed thereon with toner image P is passed between heating and fixing roll 2 constructed as shown in FIG. 5 and pressing roll 3, toner image P brought into contact with the peripheral surface of roll 2 heated by heat source 5 is fixed to support sheet 1 by melt adhesion. Fixing of the toner image is promoted by the pressure applied by pressing roll 3 to heating and fixing roll 2. Since third layer 19 has a small thickness and its outer peripheral surface is as smooth as glass, the offset phenomenon can be precluded. This permits good fixing of the toner image to be obtained.

Figure 6:
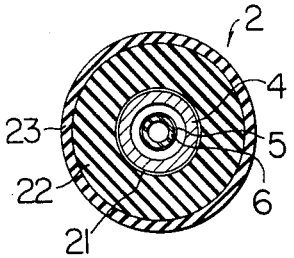
FIG. 6 is a sectional view of the fixing roll comprising a fourth embodiment of the invention.

The layers 17, 18 and 19 of the embodiment shown in FIG. 5 may be formed by any known process, such as bonding, spraying or the like. The process of adhesively bonding silicone rubber layers to the core of fixing roll 4 will be described with reference to FIG. 6. In this embodiment, fixing roll 2 has only two layers, in place of three layers, arranged around the core. An adhesive agent 21 is first applied to the outer peripheral surface of tubular shaft 4 having built-in heat source 5 therein. Then, a first layer 22 made of silicone rubber and having a thickness of 5 millimeters and a hardness of 60 is mounted on the tubular shaft 4 having adhesive layer 21 thereon so that first layer 22 may be adhesively bonded to tubular shaft 4. Finally, a second layer 23 of 100 microns in thickness and 50 in hardness is formed on the outer peripheral surface of first layer 22 by applying silicone rubber thereto.

The thickness of the outermost layer of fixing roll 2 may vary depending on the material used for making the layer. The results of experiments show that the outermost layer should have a minimum thickness of 2 microns. Since it is necessary to use an expensive material of high quality for making the outermost layer in order to preclude the offset phenomenon, it is not desirable to increase its thickness over and above the necessary level because of high cost. The outermost layer preferably has a thickness of over 30 microns, the optimum thickness being about 100 microns.

It should be understood that the second layer 18 of the embodiment shown in FIG. 5 may be made into a buffer layer disposed between first layer 17 and third layer 29. Such buffer layer may serve as an adhesive layer.

It should also be understood that an adhesive layer may be provided between the adjacent layers of the fixing roll.

The fixing roll 2 of the embodiment described above comprises two or more layers disposed around the core, the hardness of the layers being higher in going from the periphery of the roll toward the core thereof. This offers an advantage in that the roll operates smoothly without any trouble. The thickness of the layer is smaller in going from the core of the roll toward the periphery thereof. This offers an advantage in that the outer peripheral surface of the roll can readily be made as smooth as glass to preclude the offset phenomenon. Other layers than the layer nearest to the core can be formed merely by applying a suitable material, thereby facilitating production of the roll.

What is claimed is:

1. An image fixing roll for fixing toner images on sheets in electrophotography comprising a core, a plurality of coaxial and radially arranged layers of different materials disposed around the core and means for heating the fixing roll to cause toner images pressed against the fixing roll to be fused and fixed, wherein said plurality of layers comprise at least two layers, one layer being made of a material of higher hardness and the other layers being made of a material of lower hardness and the hardness of the layers being higher in going from the periphery of the roll toward the core thereof.

2. An image fixing roll according to claim 1 wherein the thickness of the layers is progressively greater in going from the periphery of the roll toward the core thereof.

3. An image fixing roller for heat fixing electrophotographic toner images on support sheets, comprising a plurality of radially arranged coaxial layers, each layer being made of a different material, with the thickness and hardness of the layers increasing in the radially inward direction.

4. An image fixing roller as in claim 3 wherein said plurality of layers includes a radially inner layer and a radially outer layer, and wherein the heat conductivity of the inner layer is substantially greater than that of the outer layer.

5. An image fixing roller as in claim 4 wherein the inner layer is made of a material whose heat conductivity is below $10^8$ ohm/cm, and wherein the outer layer is made of a heat resistive material.

6. An image fixing roller as in claim 5 wherein the outer layer is made of silicon rubber.

7. An image fixing roller as in claim 3 wherein the thickness of the outer layer is in the range of about 2 to about 100 microns.

8. An image fixing roller as in claim 3 wherein the thickness of the outer layer is in the range between about 30 and about 100 microns.

9. An image fixing roller as in claim 3 wherein said plurality of layers comprises a radially inner layer, an intermediate layer, and a radially outer layer.

10. An image fixing roller as in claim 9 wherein the hardness of the inner layer is about 70, the hardness of the intermediate layer is about 60, and the hardness of the outer layer is about 40.

11. An image fixing roller as in claim 9 wherein the inner layer is made of a material which is highly heat conductive.

12. An image fixing roller as in claim 11 wherein the inner layer is made of conductive rubber comprising 30% to 50% by weight of carbon powder.

13. An image fixing roller as in claim 11 wherein the inner layer is made of a material whose volume resistivity is below $10^8$ ohm/cm.

14. An image fixing roller as in claim 11 wherein the thickness of the outer layer is of the order of 100 microns.

15. An image fixing roller as in claim 14 wherein the outer layer is made of silicon rubber having hardness of the order of 40.

16. An image-fixing roller for heat-fixing electrophotographic toner images on support sheets, comprising:

an inner circumferential roller layer and an outer circumferential roller layer;

said inner layer being made of a rubber-like material which is resilient and is highly heat-conductive in the radially outward direction;

said outer layer being made of a rubber-like material which is resilient and heat-conductive in the radially outward direction, and is non-tacky, with an outer circumferential surface which is smooth and non-abrasive, said outer circumferential surface contacting said toner images; and wherein the hardness and the thickness of the outer layer are less than those of the inner layer.

17. An image-fixing roller as in claim 16 including an intermediate circumferential roller layer, disposed between the inner and the outer layers and made of a rubber-like material which is resilient and heat-conductive in the radially outward direction, the thickness and hardness of the intermediate layer being intermediate those of the inner and the outer layers.

18. An image-fixing roller as in claim 17 wherein the inner layer is about 5 millimeters thick and has a hardness of about 70, the intermediate layer is about 1 millimeter thick and has a hardness of about 60 and the outer layer is about 100 microns thick and has a hardness of about 40.

19. An image-fixing roller as in claim 18 wherein the inner layer is made of a material containing from about 30% to about 50% by weight carbon.

20. An image-fixing roller as in claim 16 wherein the inner roller is about 5 millimeters thick and has a hardness of about 60 and the outer layer is from about 25 to about 100 microns thick and has a hardness of about 50.

21. An image-fixing roller for heat-fixing electrophotographic toner images on support sheets, comprising:

an inner circumferential roller layer and an outer circumferential roller layer;

heat source means mounted within a region surrounded by at least said outer layer;

said inner layer being made of a rubber-like material which is resilient and is highly heat-conductive;

said outer layer being made of a rubber-like material which is resilient and non-tacky, with a non-abrasive outer circumferential surface having offset preventing properties, said outer circumferential surface contacting said toner images; and wherein the hardness and the thickness of the outer layer are less than those of the inner layer.

22. An image-fixing roller as in claim 21 including an intermediate circumferential roller layer, disposed between the inner and the outer layers and made of a rubber-like material which is resilient and heat-conductive, wherein the thickness and the hardness of the intermediate layer are intermediate those of the inner and outer layers.

* * * * *